US010704493B2

(12) United States Patent
Joffroy et al.

(10) Patent No.: US 10,704,493 B2
(45) Date of Patent: Jul. 7, 2020

(54) DEVICE FOR THERMAL COMPRESSION OF A GASEOUS FLUID

(71) Applicant: BOOSTHEAT, Nimes (FR)

(72) Inventors: Jean-Marc Joffroy, Cabanes (FR); Martin Bidar, Toulouse (FR); Luc Dando, Alzen (FR)

(73) Assignee: BOOSTHEAT, Vénissieux (FR)

( * ) Notice: Subject to any disclaimer, the term of this patent is extended or adjusted under 35 U.S.C. 154(b) by 100 days.

(21) Appl. No.: 16/038,801

(22) Filed: Jul. 18, 2018

(65) Prior Publication Data

US 2018/0328312 A1 Nov. 15, 2018

Related U.S. Application Data

(63) Continuation of application No. 14/900,100, filed as application No. PCT/FR2014/051476 on Jun. 16, 2014, now Pat. No. 10,054,078.

(30) Foreign Application Priority Data

Jun. 18, 2013 (FR) ..... 13 55745

(51) Int. Cl.
*F02G 1/053* (2006.01)
*F02G 1/057* (2006.01)

(52) U.S. Cl.
CPC ..... *F02G 1/057* (2013.01); *F02G 1/0535* (2013.01); *F02G 2253/03* (2013.01); *F02G 2253/80* (2013.01); *F02G 2280/50* (2013.01)

(58) Field of Classification Search
CPC .... F02G 1/0535; F02G 1/057; F02G 2253/03; F02G 2253/80; F02G 1/043; F02G 1/053
See application file for complete search history.

(56) References Cited

U.S. PATENT DOCUMENTS 2,157,229 A 5/1939 Bush
3,413,815 A 12/1968 Granryd
(Continued)

FOREIGN PATENT DOCUMENTS

CN 201992902 U 9/2011
CN 202023652 U 11/2011
(Continued)

OTHER PUBLICATIONS

Machine translation of CN 202023652 U, accessed Dec. 21, 2019. (Year: 2019).*

*Primary Examiner* — Jonathan R Matthias
(74) *Attorney, Agent, or Firm* — Seed Intellectual Property Law Group LLP

(57) ABSTRACT

A device for compressing a gaseous fluid includes a first chamber thermally coupled with a hot source, a second chamber thermally coupled with a cold source, a movable piston moved by a rod, and a regenerating exchanger establishing fluid communication between the first and second chambers. The rod is arranged in a cylindrical socket and guided in axial translation by a linear guiding system such as to guide the piston without contact relative to the sleeve. A sealing ring attached to the cylindrical socket surrounds the rod with a very low radial clearance, in order to limit the passage of the gaseous fluid along the mobile rod. Also disclosed is an integral cold casing having machined boreholes, a thermal screen in the hot casing, and a self-driving system with a resilient return means.

12 Claims, 6 Drawing Sheets

(56) References Cited

U.S. PATENT DOCUMENTS

| | | | | |
|---|---|---|---|---|
| 3,956,895 | A | 5/1976 | Noble et al. | |
| 4,444,011 | A * | 4/1984 | Kolin | F02G 1/053 60/517 |
| 5,465,580 | A | 11/1995 | Kwon | |
| 6,263,671 | B1 * | 7/2001 | Bliesner | F02G 1/043 60/517 |

FOREIGN PATENT DOCUMENTS

| | | | |
|---|---|---|---|
| CN | 102654325 | A | 9/2012 |
| JP | H02245452 | A | 10/1990 |
| JP | 10-062024 | A | 3/1998 |
| WO | 03/001871 | A2 | 1/2003 |

* cited by examiner

DEVICE FOR THERMAL COMPRESSION OF A GASEOUS FLUID

BACKGROUND

Technical Field

The present invention relates to gaseous fluid compression devices, and deals in particular with regenerative thermal compressors.

Description of the Related Art

Several technical solutions already exist for compressing a gas using a heat source.

In thermal compressors such as those disclosed in patents U.S. Pat. Nos. 2,157,229 and 3,413,815, the heat received is directly transmitted to the fluid to be compressed, thereby eliminating any mechanical element for the steps of compression and discharge.

In patents U.S. Pat. Nos. 2,157,229 and 3,413,815, a displacing piston ('displacer') is movably mounted inside a chamber so as to alternately displace the fluid toward the heat source or toward the cold source. The displacing piston is connected to a control rod. The displacing piston and/or the associated control rod are subject to friction and wear, which limits the service life of such compressors or which requires regular maintenance. In addition, the efficiency of the heat exchange within the compressor as well as the principle of controlling the displacing piston can be further improved.

BRIEF SUMMARY

There is therefore a need firstly to increase the service lifetime and/or reduce maintenance requirements. Secondly, improving performance through better efficiency of the heat exchanges within the compressor is a constant concern. In addition, it is desirable to improve control of the movement of the displacing piston. Finally, we must address the need to be able to manufacture the essential parts of the compressor at an attractive cost. All these needs contribute to the objective of proposing a regenerative thermal compressor providing improved performance while being competitive and easy to manufacture on an industrial scale.

To this end, a device for compression of a gaseous fluid is proposed which comprises:

- an inlet for gaseous fluid to be compressed and an outlet for compressed gaseous fluid,
- a work enclosure containing the gaseous fluid,
- a first chamber, thermally coupled with a heat source adapted to provide heat to the gaseous fluid,
- a second chamber, thermally coupled with a cold source in order to transfer heat from the gaseous fluid to the cold source,
- a piston mounted so as to be movable along an axial direction within a cylindrical sleeve and separating the first chamber and second chamber inside said work enclosure, the piston being moved by a rod integral with the piston,
- a regenerative heat exchanger and communication channels placing the first and second chambers in fluid communication, wherein the rod is arranged within a cylindrical socket rigid with the work enclosure, and the rod is guided in axial translation by a linear guiding system so as to guide the piston without contact with the sleeve, characterized in that a cylindrical sealing ring attached within the cylindrical socket surrounds the rod with a radial clearance of between 2 and 20 μm, to greatly limit the passage of gaseous fluid along the movable rod to and from an auxiliary chamber.

With these arrangements, it is possible to reduce friction significantly, both between the piston and sleeve and between the rod and its associated sealing means, while maintaining a fluidtightness compatible with the alternating cycle of pressures that is involved. One can thus obtain a reduction in the wear to moving parts and reduce the frequency of maintenance operations or even eliminate them completely. Furthermore, reducing the friction improves efficiency.

In various embodiments of the invention, one or more of the following arrangements may possibly be used.

In one aspect of the invention, the piston may have an outer edge adjacent to the sleeve and the outer edge of the piston is guided within the sleeve without friction, with a functional clearance between outer edge and sleeve of between 5 μm and 30 μm, preferably about 10 μm; whereby an absence of contact and an absence of friction is obtained while ensuring a satisfactory seal in dynamic mode during the alternating cycle.

According to another aspect of the invention, the linear guiding system may be a cylindrical roller bearing device; the rolling of the rollers provides an efficient solution for precision guidance of the rod with negligible friction.

According to another aspect of the invention, the linear guiding system may comprise plain bearings made of PTFE; this is an efficient solution for precision guidance of the rod and results in very low friction and negligible wear.

According to another aspect of the invention, the compression device is devoid of liquid lubrication; whereby the device is simple and certain problems inherent in the use of lubricants are avoided such as pollution or mixing with the working fluid.

According to another aspect of the invention, the rod can be cooled by a baffle device that deflects the flow of cooled gaseous fluid; whereby heating of the rod is avoided and the transfer of heat from the hot zone to the cold zone via the rod is reduced.

According to another aspect of the invention, the rod may have a diameter larger than one-fourth the diameter of the piston; such that the action from the pressure differential is sufficient to actuate the cycle of the self-driving device, and in addition, the quality of the guidance is improved.

According to another aspect of the invention, the device may further comprise a self-driving device acting on one end of the rod and comprising a connecting rod connected to the rod and a flywheel connected to the connecting rod; such that the operation of the device in its steady state is autonomous.

According to another aspect of the invention, the self-driving device is arranged in the auxiliary chamber filled with gaseous fluid, the sealing ring being interposed between the second chamber and the auxiliary chamber; so as to improve the overall fluidtightness of the device provided with its self-driving system.

According to another aspect of the disclosed device, which is independent of the guidance and sealing of the rod, the efficiency is also improved by limiting direct conductive heat exchanges between the hot chamber and cold chamber.

Indeed, a device for compression of a gaseous fluid is proposed which comprises:

- an inlet for gaseous fluid to be compressed and an outlet for compressed gaseous fluid, a work enclosure containing the gaseous fluid, generally rotationally symmetrical about an axis and defined by a first housing and a second housing that are assembled together, the work enclosure comprising:

a first chamber, thermally coupled with a heat source adapted to provide heat to the gaseous fluid via the first housing, a second chamber, thermally coupled with a cold source in order to transfer heat from the gaseous fluid to the cold source via the second housing, a piston mounted so as to be movable along an axial direction within a cylindrical sleeve and separating the first chamber and second chamber, the piston being moved by a rod connected to the piston, in an axial reciprocating motion, a regenerative heat exchanger arranged around the piston and placing the first and second chambers in fluid communication, a heat communication channel connecting at least one opening of the first chamber with the regenerative heat exchanger, said heat communication channel having a generally rotationally symmetrical shape about the axis, and wherein a first heat shield, formed by a thermally insulating annular cylindrical portion, is interposed between the piston and the heat communication channel, the heat communication channel being formed by a radial gap between the first heat shield and the first housing.

Thus the effects of thermal conduction are reduced, particularly in an intermediate axial portion, and the vast majority of heat exchanges between the hot and cold portions occur via the physical convective flow of the working fluid.

According to a complementary aspect, the first housing is metal and provides an insulating annular region in the form of an axial annular portion of lower thermal conduction; this further reduces heat transfer in the axial direction.

According to a complementary aspect, the annular portion having a lower heat transfer coefficient is enclosed with a collar; this provides a satisfactory mechanical strength.

According to a complementary aspect, the annular portion having a lower heat transfer coefficient (forming the insulating annular region) is integrally obtained within the first housing by forming a plurality of recesses (grooves) distributed around the heat shield; this is a simple solution with controlled internal geometry.

According to a complementary aspect, the gap forming the heat communication channel may have a width of less than 4 mm, or even less than 2 mm; such that the heat communication channel represents a very limited volume, and thus the volume of hot gases which includes the first chamber and the hot channels of working fluid all the way to the regenerator, when the piston is at the highest point, is less than 15% of the volume swept by the piston between the lowest point and the highest point.

According to a complementary aspect, the first housing has an end in the shape of a hemispherical dome, as does the upper portion of the heat shield and the upper portion of the piston; which is an optimal shape for resisting the pressure forces.

According to a complementary aspect, the piston may comprise an upper portion of low thermal conduction; this contributes to reducing the flow of heat from the hot portion to the cold portion.

According to a complementary aspect, the first housing and the second housing are assembled directly together without any intermediate part; this is a simple and robust solution.

According to a complementary aspect, the first housing comprises: a first reinforcing flange arranged between the upper domed portion and the insulating sleeve area, and a second reinforcing flange serving as a flange for mounting on the second housing; this contributes to the mechanical strength of the first housing.

According to another aspect of the disclosed device, which is independent of the guidance and sealing of the rod and of the reduction of axial thermal conduction already mentioned above, the second chamber and the cold channels of working fluid are formed as one piece (here referred to as the second housing, or "cold structural part" or "cooler"), the channels being made in the form of boreholes obtained by machining.

Indeed, a device for compression of a gaseous fluid is proposed which comprises:

an inlet for gaseous fluid to be compressed and an outlet for compressed gaseous fluid, a work enclosure containing the gaseous fluid, defined by a first housing and a second housing that are assembled together, the work enclosure comprising:

a first chamber, thermally coupled with a heat source adapted to provide heat to the gaseous fluid, a second chamber, thermally coupled with a cold source in order to transfer heat from the gaseous fluid to the cold source via the second housing, a piston mounted so as to be movable along an axial direction within a cylindrical sleeve and separating the first chamber and second chamber, the piston being movable by a rod connected to the piston, in an axial reciprocating motion, a regenerative heat exchanger arranged around the piston and placing the first and second chambers in fluid communication, at least one cold communication channel connecting at least the second chamber to the regenerative heat exchanger, this cold communication channel comprising a plurality of axial boreholes arranged in the second housing around the second chamber.

In this manner, the passages of the cooling communication channel are obtained by machining one solid part, which reduces the number of parts required and also reduces the dead volume in the cold portion.

According to a complementary aspect, first auxiliary cold channels conveying the coupling fluid from the cold source run parallel to the axial direction, and second auxiliary cold channels run perpendicularly to the axial direction and serve as a manifold for the first auxiliary cold channels connected thereto; the heat exchanger is thus easily obtained by the proximity of the auxiliary channels to the cold channel of working fluid.

According to an alternative complementary aspect, all the first auxiliary channels conveying the coupling fluid from the cold source run perpendicularly to the axial direction; this is easy to machine industrially and eliminates having to cap certain pipes.

According to a complementary aspect, the second housing 12 comprises a cylindrical cavity adapted to receive the lower portion of the piston and a circular groove arranged at the base of the cylindrical cavity and serving as a lower manifold connecting the bottom exit of the boreholes;

thereby reducing the dead volume by the small volume of the manifold for the cold channels.

According to a complementary aspect, a baffle is arranged at the bottom of the cylindrical cavity, said baffle defining, together with the bottom of the second chamber, a disc-shaped recess which is part of the cold communication channel; whereby heating of the rod is avoided and the transfer of heat from the hot zone to the cold zone via the rod is reduced.

According to a complementary aspect, the second housing may be a single unitary part including the lower portion of the cylindrical sleeve, the cold communication channel, and the various auxiliary cold channels, as well as the inlets and outlets for the working fluid; which reduces the number of required parts in the cold portion.

According to a complementary and additional aspect, the volume of cold gases which includes the second chamber and the cold channels of working fluid all the way to the regenerator, when the piston is at the lowest point, is less than 15% of the volume swept by the piston between the lowest point and the highest point; which helps to improve thermal efficiency.

According to another aspect of the disclosed device, which is independent of the guidance and sealing of the rod, the reduction of the axial thermal conduction and the constructive structure of the cold part mentioned above, improving the control of piston movement is proposed.

To this end, a device for compression of a gaseous fluid is proposed which comprises:

- an inlet for gaseous fluid to be compressed and an outlet for compressed gaseous fluid,
- a work enclosure containing the gaseous fluid,
- a first chamber, thermally coupled with a heat source adapted to provide heat to the gaseous fluid,
- a second chamber, thermally coupled with a cold source in order to transfer heat from the gaseous fluid to the cold source,
- a piston mounted so as to be movable along an axial direction within a cylindrical sleeve and separating the first chamber and second chamber, the piston being movable by a rod connected to the piston, in an axial reciprocating motion,
- a regenerative heat exchanger placing the first and second chambers in fluid communication, the compression device comprising a self-driving device acting on one end of the rod and comprising: a connecting rod connected to the rod and a flywheel connected to the connecting rod; and a resilient double-acting return means, connected to the rod and having a neutral point corresponding to a position at or near the mid-stroke of the piston.

With these arrangements, the resilient return means cyclically stores energy, in parallel with the energy stored in the flywheel, which allows reducing the forces on the bearings of the rod-flywheel assembly and allows sizing said assembly as correctly as possible.

According to a complementary aspect, the resilient return means may comprise two springs working in opposition; it is thus possible to avoid hysteresis and dead travel and/or to compensate for variations in spring characteristics.

According to a complementary aspect, the self-driving device may comprise a motor magnetically coupled to the flywheel; thereby providing an initial starting push and then regulating the speed of rotation.

According to a complementary aspect, the self-driving device is arranged in an auxiliary chamber in which a mean pressure prevails which is half the sum of the inlet pressure P1 and outlet pressure P2; balanced and limited exchanges with the second chamber are thus obtained.

Finally, the invention also relates to a thermal system comprising a heat transfer circuit and at least one compressor according to one of the preceding characteristics. The thermal system in question may be intended to extract heat from an enclosed area and in this case it is an air conditioning or refrigeration system, but the thermal system in question may also be intended to add heat to an enclosed area and in this case it is a heating system such as residential heating or industrial heating.

BRIEF DESCRIPTION OF THE SEVERAL VIEWS OF THE DRAWINGS

Other features, objects, and advantages of the invention will become apparent from the following description of some embodiments of the invention, given by way of non-limiting examples. The invention will also be better understood with reference to the accompanying drawings, in which.

DETAILED DESCRIPTION

Figure 1:
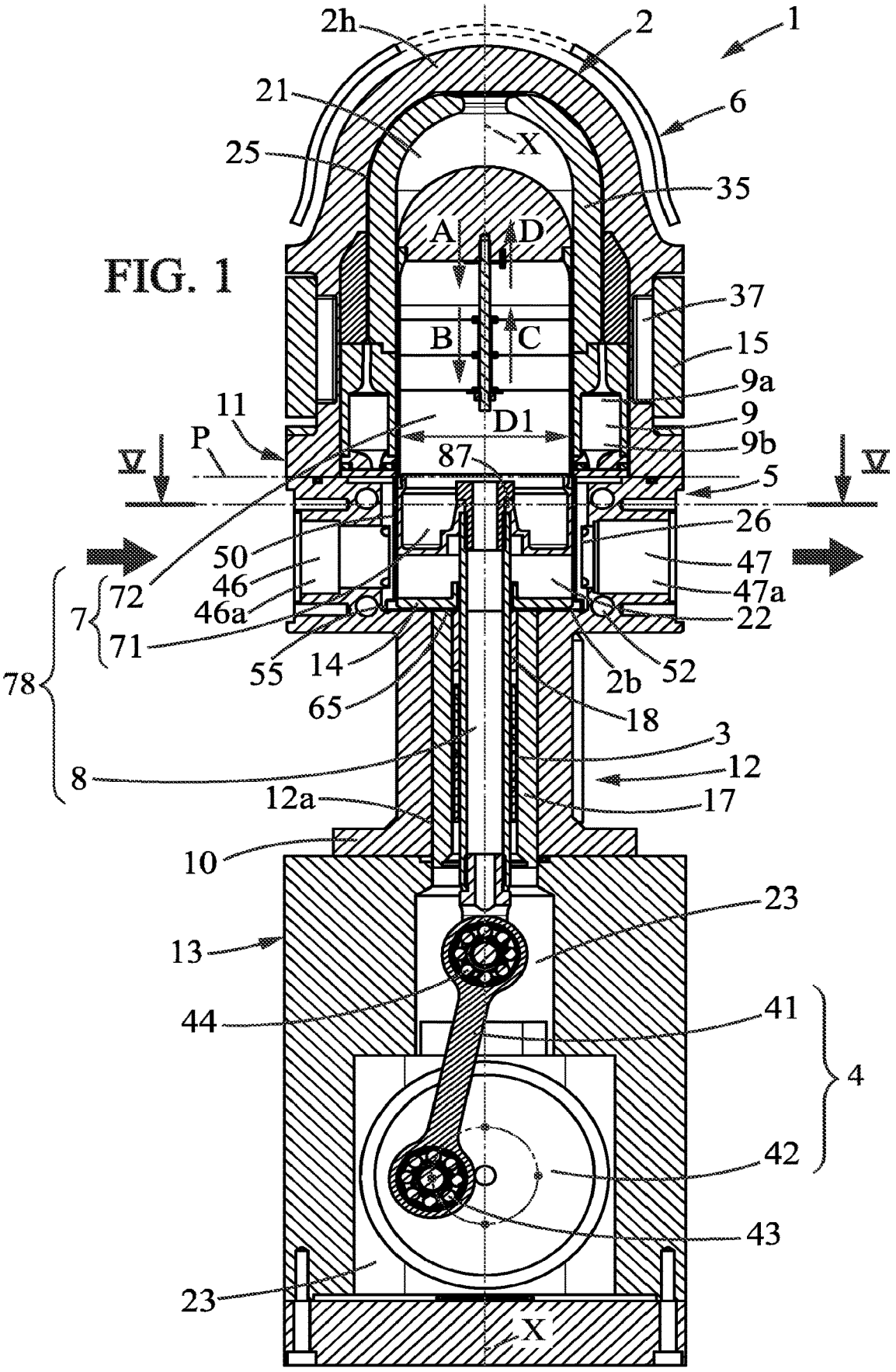
FIG. 1 is a schematic axial sectional view of a device for compressing gaseous fluid according to the invention.

In the various figures, the same references designate identical or similar elements, FIG. 1 shows a device 1 for compression of a gaseous fluid, adapted for admitting a gaseous fluid (also called "working fluid") through an inlet or intake 46 at a pressure P1, and supplying the compressed fluid at pressure P2 at an outlet denoted 47.

As represented in FIGS. 1 to 12, the device is designed around an axial direction X, which is preferably oriented vertically, but this does not exclude another arrangement. A piston 7 is mounted so as to be movable along this axis at least within a cylindrical sleeve 50. Said piston hermetically separates two enclosed spaces, respectively referred to as the first chamber 21 and second chamber 22, these two chambers being contained within a work enclosure 2 that is hermetic (except for said inlets/outlets). The work enclosure 2 has an upper end 2*h* and a lower end 2*b*. The piston has a dome-shaped upper portion, for example hemispherical.

The work enclosure 2 is defined by a first housing 11, arranged in the upper portion of the assembly and in thermal contact with the heat source at least in the upper area, and by a second housing 12, arranged in the lower portion and cooled by the cold source. Using known English terms, the first housing 11 can be called a "heater" and the second housing 12 can be called a "cooler". The cylindrical sleeve 50 extends both into the second housing and inside the first housing, in contact with a part called the "heat shield" 35 which will be further discussed below.

The first housing 11 is manufactured of stainless steel or of a metal alloy sufficiently resistant to withstand the temperatures of the hot portion. The second housing 12 is preferably made of a light metal alloy, as its operating temperature is lower.

In the example shown, the first housing 11 and second housing 12 are directly assembled together without any intermediate part. However, they could be assembled together with one (or more) intermediate part(s).

The first chamber 21, also called the "hot chamber", is arranged above the piston and is thermally coupled to a heat source 6 adapted to provide heat to the gaseous fluid. The first chamber is rotationally symmetrical, with a cylindrical portion having a diameter corresponding to the diameter D1 of the piston and a hemispherical portion at the top.

The heat source 6 entirely surrounds the hot chamber 21, and in particular is in contact with the first housing 11.

The second chamber 22, also called the "cold chamber", is arranged below the piston and is thermally coupled with a cold source 5 in order to transfer heat from the gaseous fluid to the cold source. The second chamber is generally cylindrical, having a diameter D1 corresponding to the diameter of the piston.

Around the cylindrical sleeve 50 is arranged a regenerative heat exchanger 9, of the type conventionally used in Stirling-type thermodynamic engines. This exchanger 9 (also simply called a "regenerator" in the following) comprises fluid channels of small cross-section and elements for storing thermal energy and/or a dense network of metal wires. This regenerator 9 is arranged at an intermediate height between the upper end 2*h* and the lower end 2*b* of the work enclosure and has a hot side 9*a* towards the top and a cold side 9*b* towards the bottom. The hot side 9*a* is connected (in fluid communication) with the first chamber 21 by means of a heat communication channel 25 which includes manifolds 28, an annular passage 25, which connects to an opening 24 located at the top of the first chamber 21.

The upper portion of the annular passage 25 allows fluid to lap against the upper portion of the first housing 11, where it is particularly hot as it is in contact with the heat source (very good thermal coupling).

The heat communication channel 25 is formed by a thin radial gap (<4 mm, even <2 mm, even about 1 mm) formed between the first housing 11 and a part comprising a first heat shield. The first heat shield 35, formed by a thermally insulating annular cylindrical portion, is interposed between the piston 7 and the heat communication channel 25, and as a result the working fluid does not heat the side portions of the piston.

The first heat shield 35 is made of ceramic or of a high temperature insulator. Its thickness is substantially constant in the example illustrated.

The cylindrical portion may be extended at the top by a hemispherical portion of substantially constant thickness, this hemispherical portion being configured to match the shape of the outer surface of the piston when the latter is in its uppermost position; the top of the hemispherical portion is provided with an opening 24 to allow the passage of flows into and out of the first chamber 21.

The cold side 9*b* of the regenerator 9 is connected (in fluid communication) with the second chamber 22, by means of a cold communication channel which comprises manifolds 27 and cold channels 26 in the form of boreholes in the second housing, their arrangement to be specified below.

As is apparent from the figures, when the piston moves, the sum of the volumes of the first and second chambers 21,22 remains substantially constant, except that the volume occupied by the rod 8 is slightly greater when the piston is in its uppermost position. In addition, the volume of working fluid contained in the regenerator 9, the cold channels 26,27, and the heat communication channel 28,25 is constant, and therefore the total volume of gaseous fluid in the work enclosure 2 is more or less constant.

According to the advantageous constructive architecture chosen, the volume of hot gases which includes the first chamber 21 and the hot channels 25 all the way to the regenerator, when the piston is at its uppermost position, is less than 15% of the volume swept by the piston between the lowest point and the highest point, or even less than 10%.

Similarly, the volume of cold gases when the piston is at the lowest point, which includes the residual volume of the second chamber 22 and the cold communication channels 26, is less than 15% of the total volume swept by the piston, or even less than 10%.

From the point of view of its structural architecture, the device comprises:

- the second housing 12 which defines the second chamber 22 by means of the abovementioned sleeve together with the lower portion of the piston; this part is relatively solid, and further includes the inlet 46 and outlet 47 for the fluid,
- the first housing 11, which defines the first chamber 21 by means of the inner surface of the heat shield 35 together with the top of the piston 7*h*, and which comprises an insulating sleeve area formed by a portion of lower thermal conduction 37 that faces part of the regenerator (see FIG. 12),
- the heat shield 35 forming the cylindrical sleeve 50 on its inner surface and defining on its outer surface the radially inner surface of the heat communication channel 25,
- an auxiliary heat shield 36 interposed between the heat communication channel 25 and the portion 37 of lower conduction of the first housing,
- a mobile assembly 78 comprising said piston 7 and a rod 8 integral to the piston; said rod 8 has a round cross-section of diameter D2 and provides a centering and attachment system 87 on the axis of the piston;
- the aforementioned regenerator 9, arranged inside the upper structural part 11 and around the sleeve 50.

Below the rod 8 is arranged a system for controlling the movement of the piston, which is contained within an auxiliary housing 13 that defines a third chamber 23 or auxiliary chamber 23. The auxiliary housing 13 is fixed to a flange 10 that is part of the first housing 11, by means of screws threaded through holes 160.

Optionally, the device may also comprise a specific self-driving device 4 as its control system, which will be discussed further below.

In addition, the second housing 12 comprises an axial bore 12*a* which receives a snugly fitted cylindrical socket 17 having an inner cylindrical surface that is machined with precision. The socket is force-fitted into the bore 12*a* of the lower structural part 12.

This socket 17 receives a linear guiding system 3 which accurately guides the rod 8 in order to accurately guide the piston 7, preferably with no contact with the sleeve as will be explained further below.

In the illustrated example, the linear guiding system 3 is a cylindrical roller bearing, preferably a cylindrical sheath 30 with balls or rollers 31. The rollers 31 roll on the socket and the sheath 30 moves at half the speed of the rod 8.

In an alternative (not shown), the linear guiding system 3 may comprise plain bearings made of PTFE (Polytetrafluoroethylene).

Figure 6:
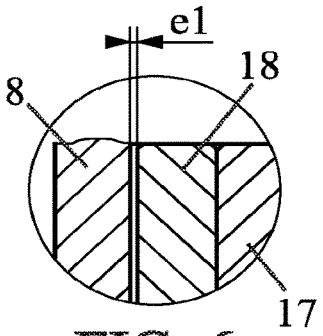
FIG. 6 shows details concerning the sealing ring.

For fluidtightness with respect to the movable rod, a cylindrical sealing ring 18 is fixed within the cylindrical socket 17 and is separate from the guiding system; this sealing ring 18 surrounds the rod with a radial clearance el of between 2 and 20 μm, greatly limiting the passage of gaseous fluid along the movable rod 8 (see FIG. 6). Preferably, the radial clearance el is preferably between 10 and 15 μm.

Due to the precision guidance of the rod, precision guidance of the piston is accordingly obtained due to the rigid attachment of the piston to the rod. More precisely, the piston 7 has an outer edge 73,74 arranged adjacent to the sleeve 50 and the outer edge of the piston is guided within the sleeve without friction with a functional clearance e2 between the outer joining edge and the sleeve of between 5 μm and 30 μm, preferably about 10 μm (see FIG. 7). The outer edge is preferably integrally obtained from the lower portion 71 of the piston, but any other solution is possible.

Due to this precise geometry, satisfactory fluidtightness is obtained in dynamic mode during the reciprocating movements of the piston, the frequency of the alternating movements being between a few Hertz and a few tens of Hertz to a few hundred Hertz.

In addition, this arrangement prevents any wear due to friction or contact; one can thus do without any liquid lubrication, such that the device is devoid of liquid lubrication.

Unlike a positive displacement compressor, in this thermal compressor it is the heat exchanges which move the piston and not the rod and connecting rod. Therefore there is very little radial force on the rod and piston in this thermal compressor, which allows accurate guidance and no friction as mentioned above. We thus obtain a service life of tens of thousands of hours without maintenance.

The fluid selected as the working fluid may be any suitable fluid, in particular any light gas; it may be ammonia, but CO2 may be chosen for environmental reasons.

According to an example implementation of the invention, the temperature of the cold portion is in the vicinity of 50° C., while the temperature of the hot portion is in the vicinity of 650° C.

Figure 12:
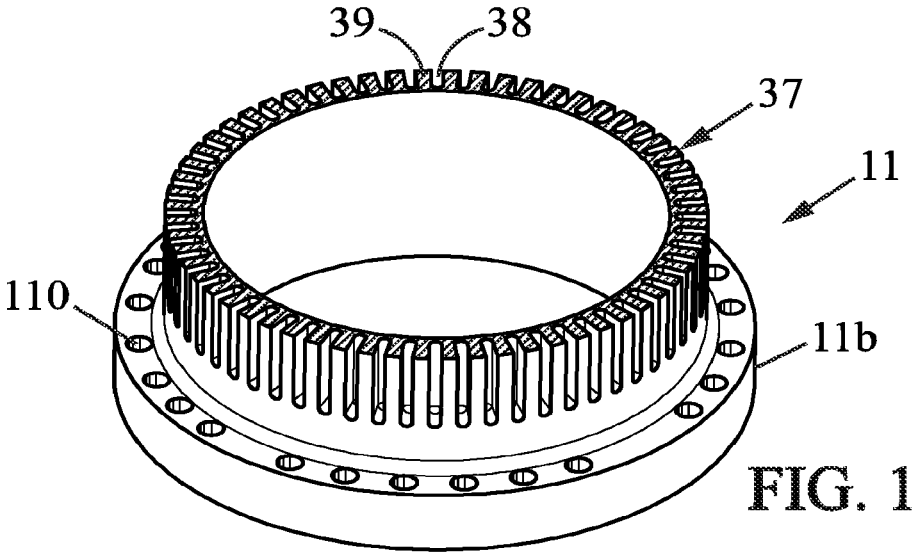
FIG. 12 shows a partial view of the first housing, illustrating the portion having the lowest heat conductivity.

The insulating sleeve 37 is obtained by a plurality of recesses 38 separated by radial walls 39 as shown in FIG. 12, this alternation of recesses and radial walls being repeated around the entire circumference of the first housing of the upper portion of the regenerator 9.

Around the thermally insulating sleeve area is arranged a collar 15 which is intended to reinforce the mechanical strength of the first housing in the area of lowest heat conductivity. The end of the radial walls 39 is forced radially inward by the presence of this collar 15, which can be mounted with slight prestressing and therefore providing satisfactory mechanical strength of this intermediate portion of the first housing 11.

In addition, the first housing 11 comprises a first reinforcing flange 11 a arranged between the upper domed portion and the insulating sleeve area, and a second reinforcing flange 11*b* serving as a mounting flange for attachment to the second housing 12.

The first housing 11 is assembled to the second housing 12 at the interface plane P by means of a plurality of screws inserted through holes 110 at the bottom of the hot part (flange 11*b* of the first housing 11) and holes 112 at the top of the cold part, which may be threaded holes.

Operation of the compressor is ensured by the reciprocating motion of the piston 7, as well as by the action of an inlet valve 46*a* on the inlet 46, and a check valve 47*a* for discharging through the outlet 47.

Figure 8:
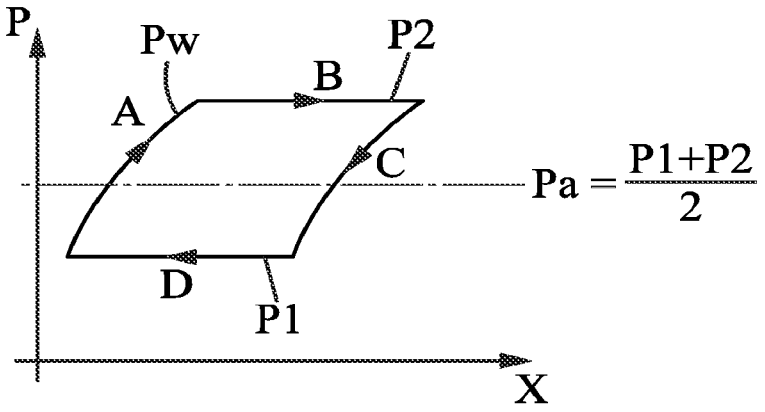
FIG. 8 shows a diagram of the thermodynamic cycle implemented in the device, in particular for the self-driving device.

The various steps A, B, C, D, described below are shown in FIGS. 1 and 8.

Step A.

The piston, initially at the top, moves downward and the volume of the first chamber 21 increases while the volume of second chamber 22 decreases. This pushes the fluid through the regenerator 9 from bottom to top and heats it in the process. The pressure Pw increases concomitantly.

Step B.

When the pressure Pw exceeds a certain value, the outlet valve 47*a* opens and the pressure Pw settles at the compressed fluid discharge pressure P2, and fluid is expelled at the outlet (the inlet valve 46*a* of course remains closed during this time). This continues until the piston reaches the bottom stopping point.

Step C.

The piston is now moving from the bottom upwards and the volume of the second chamber increases while the volume of the first chamber decreases. This pushes the fluid through the regenerator 9 from top to bottom, and cools it in the process. The pressure Pw decreases concomitantly. The outlet valve 47*a* closes when the upward movement begins.

Step D.

When the pressure Pw drops below a certain value, the inlet valve 46*a* opens and the pressure Pw settles at the fluid intake pressure P1, and fluid is drawn through the inlet 46 (the outlet valve 47*a* of course remains closed during this time). This continues until the piston reaches the top stopping point. The inlet valve 46*a* will close when the piston begins its descent.

The movements of the rod 8 can be controlled by any suitable driving device arranged in the auxiliary chamber 23. In the illustrated example, there is a self-driving device 4 acting on one end of the rod. This self-driving device 4 comprises a flywheel 42, and a connecting rod 41 connected to said flywheel by a pivoting connection, for example a roller bearing 43. The connecting rod 41 is connected to the rod by another pivoting connection, for example a roller bearing 44.

In the example illustrated, the self-driving device 4 is housed in an auxiliary chamber 23 filled with the gaseous working fluid at a pressure denoted Pa. The sealing ring 18 is interposed between the second chamber 22 and the auxiliary chamber 23. When the device is in operation, the pressure Pa in the auxiliary chamber 23 converges to an average pressure substantially equal to half the sum of the min P1 and max P2 pressures. When the device is shut down for some time, the pressure in the auxiliary chamber Pa becomes equal to the pressure in the second chamber 22. In fact, due to the functional clearance of between 2 and 20 μm between the ring 18 and the rod 8, the very slight leak does not allow maintaining a pressure differential over the long term, but in dynamic mode this very slight leak does not affect operation and remains negligible.

When the flywheel rotates one turn, the piston sweeps a volume corresponding to the distance between the uppermost point and the lowermost point, multiplied by the diameter D1.

The diameter of the rod D2 is greater than one-fourth the diameter D1 of the piston, such that the pressure exerted on the piston is (Pw−Pa)×D2.

The thermodynamic cycle, as represented in FIG. 8, provides positive work to the self-driving device.

As illustrated in FIG. 8, the forces exerted on the piston provide energy to the flywheel during steps A,B while in step C, D it is the flywheel which supplies power to the piston train, knowing that the piston must at all times overcome the minimal residual friction or rolling resistance. The work provided by the complete cycle has a positive balance; as a result, the reciprocating motion of the piston 7 can be self-maintained by said driving system 4.

The self-driving work is proportional to the cross-section of the rod, and therefore the cross-section of the rod will be selected to generate sufficient work. For example, a diameter D2 that is at least one-fourth the diameter D1 of the piston will be chosen.

An electric motor (not shown) is coupled, in the present example by magnetic means, with the flywheel. This motor will give an initial push to start the cycle. The motor also serves to regulate the cycling speed when in steady state. The magnetic coupling between motor and flywheel eliminates any rotating joint issues and the associated potential leaks.

Figure 10:
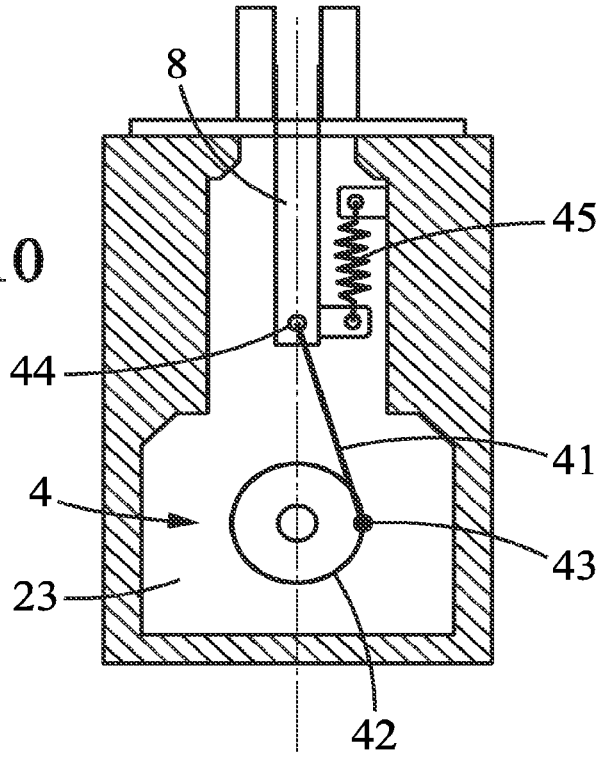
FIG. 10 shows a second embodiment concerning the self-driving device.

In addition, advantageously according to an optional aspect illustrated in FIG. 10, there is an additional double-acting resilient return means 45, which operates in parallel with the abovementioned rod-flywheel assembly. For example, this may be formed by a spring alternately pulled and compressed and having a length at rest that is chosen so as not to exert any force at the cycle midpoint.

The elastic return means cyclically stores and restores energy.

Alternatively, there may be two springs which work antagonistically and exert forces that are balanced at the cycle midrange.

Advantageously, the forces on the rod-flywheel assembly are reduced because a portion of the forces is supported by the resilient return system.

One can thus more accurately dimension the bearings 43,44, which contributes to optimization of the driving mechanism and to the lack of need for maintenance.

Figure 11:
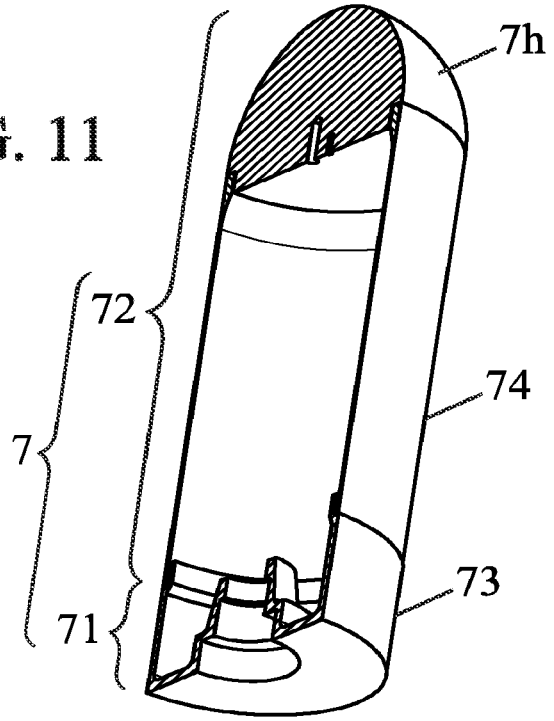
FIG. 11 shows the piston assembly.

To minimize heat transfer by conduction, the piston is constructed in two parts, as shown in particular in FIG. 11: a base 71 with very precise geometric characteristics as described above (in particular the edge 73) and a head 72 which is made of a material offering little heat conductivity or made as several tiers separated by thermal insulation.

In addition, the rod 8 is cooled by a baffle device 14 that deflects the flow of cooled gaseous fluid; this device guides the fluid so that the cooled gaseous fluid laps against the rod 8 and cools it.

The baffle 14 is in the form of a disc of outer diameter D1 with a central hole of a slightly larger diameter than that D2 of the rod (see FIG. 2), thereby defining a passage 14*a*, which causes the cold working fluid to lap against the rod 8 and cool it.

Figure 3:
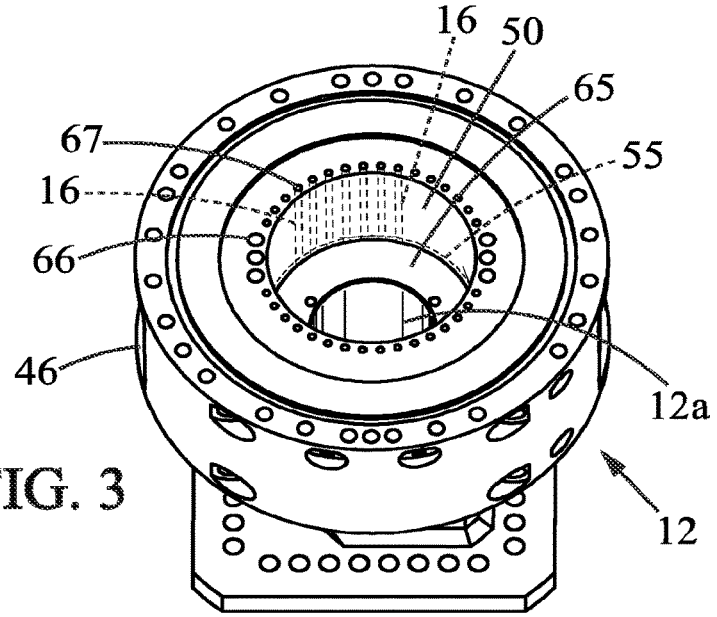
FIG. 3 shows a perspective view of a cold part comprised in the device of FIG. 1.
Figure 4:
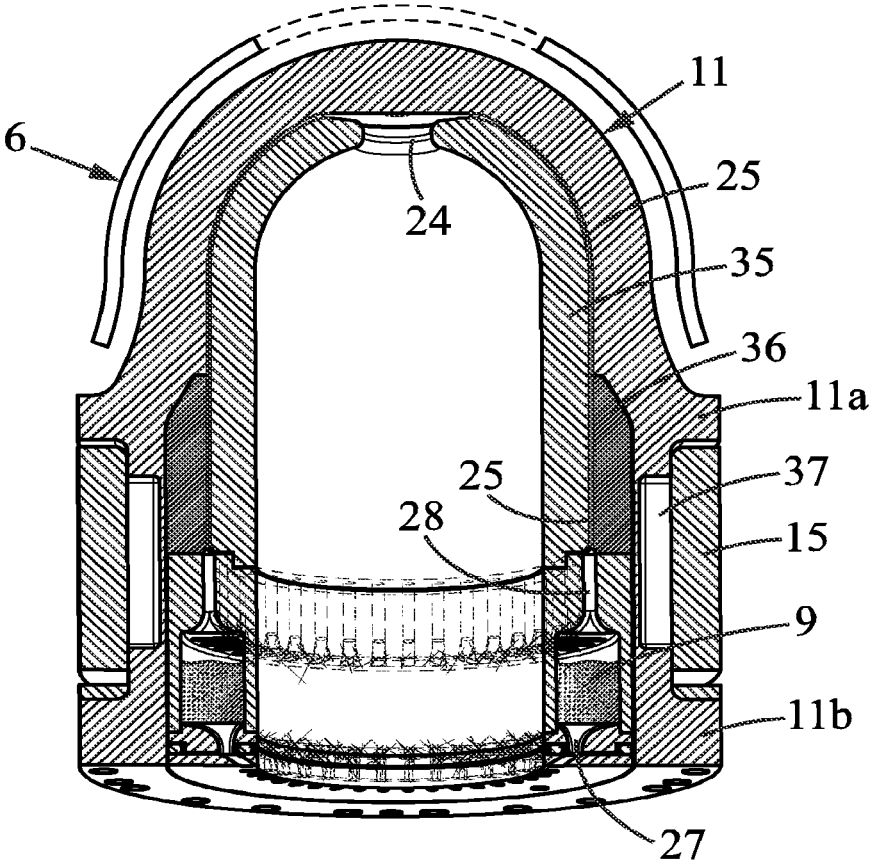
FIG. 4 shows a perspective view of the hot portions comprised in the device of FIG. 1.
Figure 7:
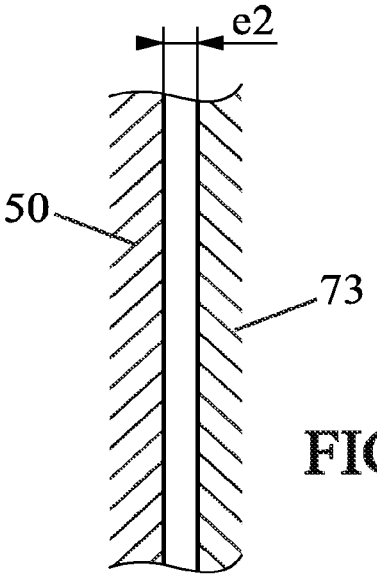
FIG. 7 shows details of the piston-sleeve interface.
Figure 5:
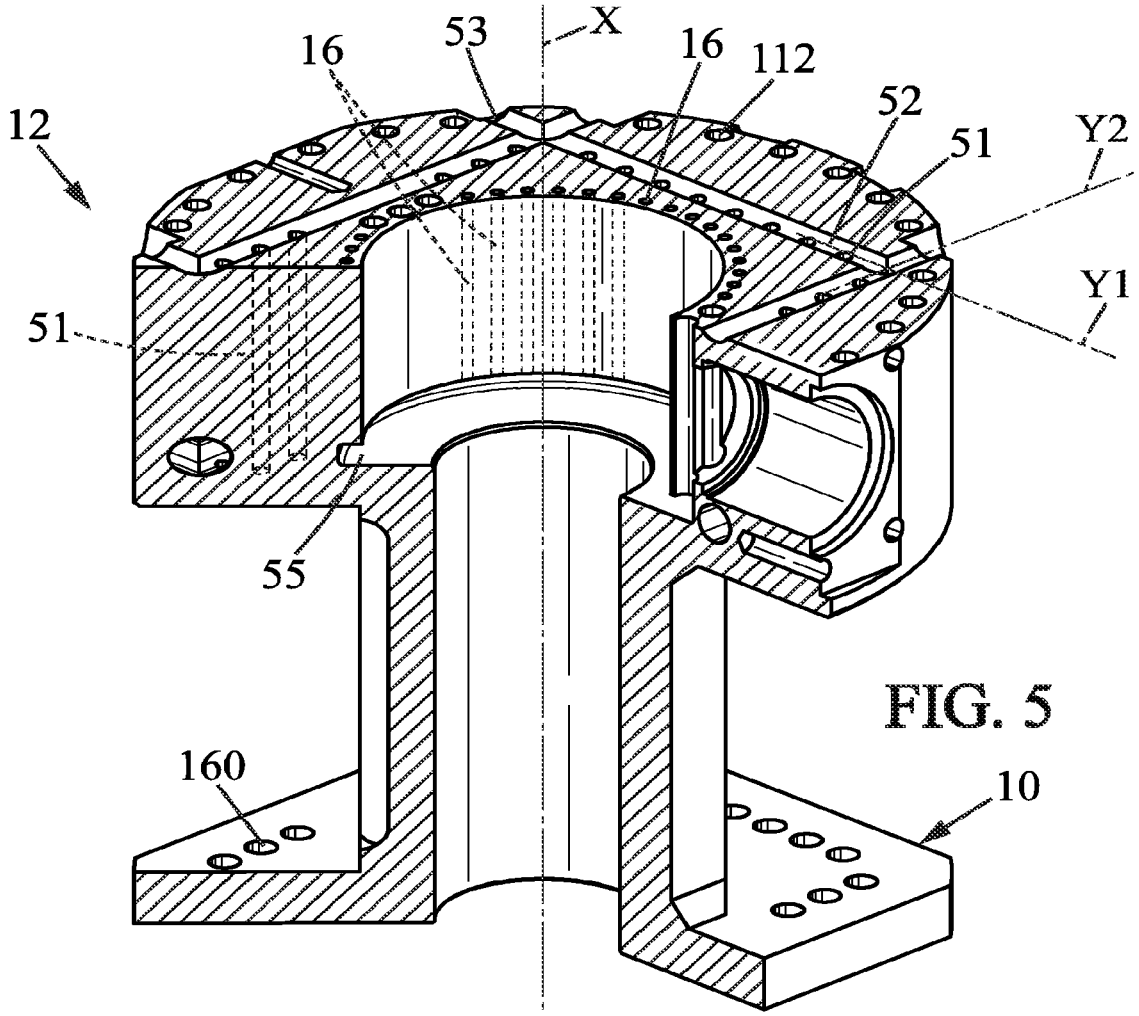
FIG. 5 shows a perspective view of the cold part of FIG. 3, with cross-section and cutaway.

The channels are created as boreholes machined in the lower structural part 11, in other words the first housing or "cooler". Preferably, the first housing is a solid single part as shown in FIGS. 3 and 5.

The cold channels 26 of gaseous working fluid are formed at this location by boreholes 16 running parallel to the axial direction X and arranged circumferentially adjacent to one another around the second chamber. Said boreholes 16 comprise boreholes of small diameter 67 and boreholes of larger diameter 66 in the diametrical areas of connection to the inlet 46 and outlet 47.

In addition, first auxiliary cold channels 51 conveying the coupling fluid from the cold source run parallel to the axial direction and are arranged in a square facing the holes 160 of the flange 10; in addition, other second auxiliary cold channels 52 extend along Y1 perpendicularly to the axial direction and serve as the manifold for the first auxiliary cold channels 51 by connecting to them (see FIG. 5); in addition, other second auxiliary cold channels 53 extend along Y2 perpendicularly to X and to Y1.

The first auxiliary cold channels 51 and the second auxiliary cold channels 52 are also created by boreholes through the solid part formed by the first housing 11.

Figure 2:
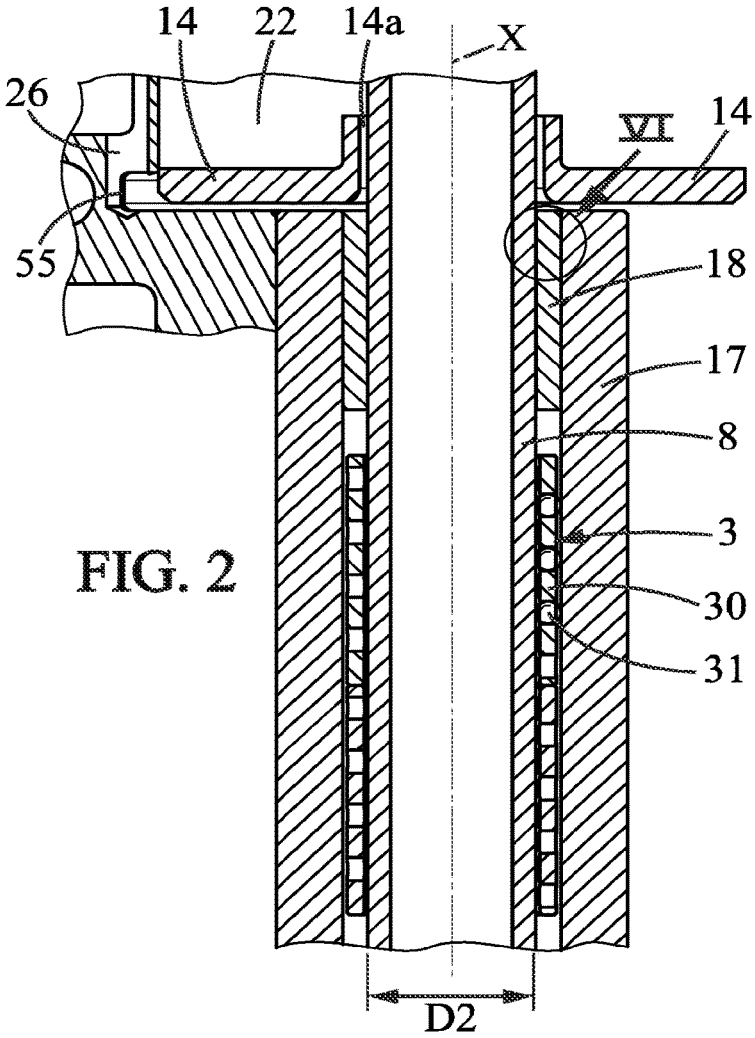
FIG. 2 shows a partial detail view of the rod guidance.

In addition, the cold chamber comprises a lower groove 55 of a diameter greater than the diameter D of the piston, which serves as a manifold for the cold channels 26 (boreholes 16) to place said cold channels 26 in communication with the bottom 65 of the second chamber 22 (see FIGS. 2 and 3).

Figure 9:
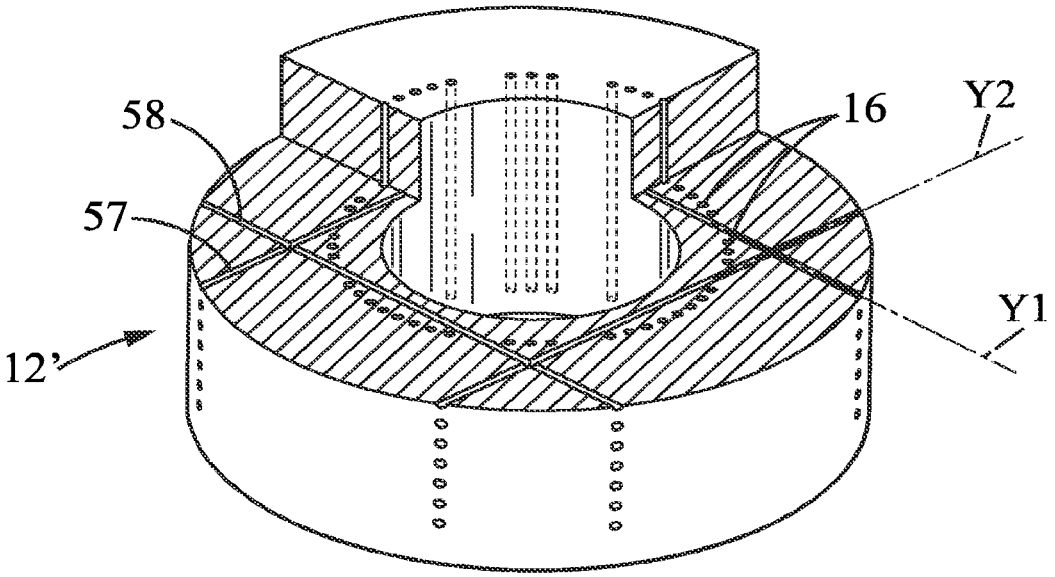
FIG. 9 shows a second embodiment of the cold part.

In addition, according to an alternative solution represented in FIG. 9, all the first auxiliary cold channels 57,58 are obtained by boreholes perpendicular to the axial direction. A first series 57 of boreholes are arranged along Y2, one above the other and passing through the circle on which are arranged boreholes 16; a second series 58 of boreholes are also arranged one above the other along Y1, intersecting the boreholes 57 of the first series at right angles and in fluid communication therewith, and also passing through the circle on which are arranged boreholes 16. This variant offers certain advantages in the industrial production of such a solid part and in its machining.

It should be noted that the check valves 46*a*, 47*a* may be of any type commonly used in compressors and are not necessarily placed close to the inlet and outlet 46,47.

It should be noted that the arrangement of the device could be reversed, namely with the cold portion at the top and the hot portion at the bottom, but it is understood that the vertical arrangement eliminates the effects of gravity with respect to the radial direction of the device and in particular with respect to guiding the rod and guiding the piston and eliminating friction.

It should be noted that to increase the level of compression, it is possible to arrange several compression devices as described above in series.

It should be noted that the boundary between the first housing and the second housing may be located at a different position.

The insulating sleeve 37 may be formed by a specific part interposed between the first and second housings.

The invention claimed is:

1. A compression device for compressing a gaseous fluid, comprising:

an inlet for the gaseous fluid to be compressed and an outlet for the gaseous fluid in compressed form, a work enclosure containing the gaseous fluid, a first chamber, thermally coupled with a heat source adapted to provide heat to the gaseous fluid, a second chamber, thermally coupled with a cold source in order to transfer heat from the gaseous fluid to the cold source, a piston mounted so as to be movable along an axial direction within a cylindrical sleeve and separating the first chamber and second chamber, the piston being movable by a piston rod connected to the piston, in an axial reciprocating motion, a regenerative heat exchanger placing the first and second chambers in fluid communication, an auxiliary chamber, and a self-driving device acting on one end of the piston rod and comprising: a connecting rod coupled to the piston rod, a flywheel connected to the connecting rod, and a resilient double-acting return means coupled to the rod and having a neutral point corresponding to a position at or near a mid-stroke of the piston, wherein the connecting rod, flywheel, and resilient double-acting return means are positioned in the auxiliary chamber.

2. The compression device according to claim 1, wherein the double-acting resilient double-acting return means cyclically stores energy, in parallel with energy stored in the flywheel.

3. The compression device according to claim 1, wherein the resilient double-acting return means is a spring, working in traction and in compression.

4. The compression device according to claim 1, wherein the resilient double-acting return means comprises two springs working in opposition.

5. The compression device according to claim 1, wherein the self-driving device comprises a motor coupled to the flywheel.

6. The compression device according to claim 5, wherein the motor is an electric motor that is magnetically coupled to the flywheel.

7. The compression device according to claim 1, wherein the auxiliary chamber is fluidly coupled to the second chamber by a gap that enables the auxiliary chamber to have a mean pressure that is half of a sum of an inlet pressure at the inlet and an outlet pressure at the outlet during operation of the compression device.

8. The compression device according to claim 1, wherein the self-driving device comprises a first roller bearing that rotatably couples the connecting rod to the flywheel.

9. The compression device according to claim 8, wherein the connecting rod is connected to the piston rod by a second roller bearing.

10. A thermal system comprising a heat transfer circuit and at least one compression device according to claim 1.

11. The compression device according to claim 1, wherein the inlet and outlet are respective openings through the work enclosure and fluidly couple the second chamber to an external environment, the compression device further comprising:

an inlet valve configured to open and close the inlet; and an outlet valve configured to open and close the outlet.

12. The compression device according to claim 11, wherein the inlet valve is configured to open when a pressure of the gaseous fluid in the second chamber is less than a first value and the outlet valve is configured to open when the pressure of the gaseous fluid in the second chamber is greater than a second value.

* * * * *